US005646914A

United States Patent [19]

Blunschi et al.

[11] Patent Number: 5,646,914

[45] Date of Patent: Jul. 8, 1997

[54] WRISTWATCH WITH SCREW-IN WINDER

[75] Inventors: Daniel Blunschi, Kerzers; Fredy Streuli, Kusnacht, both of Switzerland

[73] Assignee: UTC Service AG, Basel, Switzerland

[21] Appl. No.: 640,882

[22] PCT Filed: Sep. 21, 1995

[86] PCT No.: PCT/CH95/00210

§ 371 Date: Oct. 4, 1996

§ 102(e) Date: Oct. 4, 1996

[87] PCT Pub. No.: WO96/09572

PCT Pub. Date: Mar. 28, 1996

[30] Foreign Application Priority Data

Sep. 22, 1994 [CH] Switzerland ..... 2888/94

[51] Int. Cl.[6] ..... G04B 37/00; G04B 29/00

[52] U.S. Cl. ..... 368/308; 368/319

[58] Field of Search ..... 368/190, 206–216, 368/306, 308, 319–321

[56] References Cited

U.S. PATENT DOCUMENTS

| | | | |
|---|---|---|---|
| 1,114,947 | 10/1914 | Verberckmoes | 368/308 |
| 1,178,918 | 4/1916 | Hall . | |
| 2,892,303 | 6/1959 | Schwartz | 368/308 |
| 2,912,818 | 11/1959 | Sharpiro | 368/308 |
| 4,313,187 | 1/1982 | Waki et al. | 368/319 |

FOREIGN PATENT DOCUMENTS

| | | |
|---|---|---|
| 455344 | 7/1928 | France . |
| 1367566 | 4/1970 | Switzerland . |

*Primary Examiner*—Vit W. Miska

*Attorney, Agent, or Firm*—Tarolli, Sundheim, Covell, Tummino & Szabo

[57] ABSTRACT

In the case of a wristwatch (1) with a clockwork (13), which is surrounded by a case (4) and is operable by means of a winder (20) fitted in rotary manner to the outside of the case (4) by a spindle (7) guided through said case (4) and in which the winder (20) is constructed in sealed, screw-in manner, incorrect operation is largely avoided in that signalling or indicating means are provided in operative connection with the winder (20) and indicate whether or not the winder (20) is in the screwed in state.

10 Claims, 2 Drawing Sheets

WRISTWATCH WITH SCREW-IN WINDER

TECHNICAL FIELD

The present invention is in the field of wristwatches. It relates to a wristwatch having a clockwork, which is surrounded by a case and which is operable by means of a winder fitted in rotary manner to the outside of the case using a spindle passed through the case, said winder being constructed in sealing, screw-in manner.

Such a wristwatch is e.g. known from CH-A3-682 968.

PRIOR ART

In the case of wristwatches, which are wound up, adjusted or otherwise operated by means of a winder, the passage of the spindle connected to the winder through the watch case represents a weak point with respect to the seal against dust, water and other environmental influences.

Thus, in the past numerous solutions have been proposed by means of which the winder can be screwed in and in the screwed-in state ensures an increased sealing action. Examples for screw-in winders can be gathered from Swiss patents 468 663, 582 908 and 616 809, or German patents 30 17 496 and 33 13 515, or the document referred to hereinbefore.

It is common to all these solutions that on screwing in the winder an additional seal is used, which is compressively stressed and therefore permits an improved sealing action and higher pressure differences between the inner and outer area of the watch. However, if the clockwork is to be operated by means of the winder, the latter must be unscrewed beforehand. As a result of the unscrewing the additional sealing function associated with the screwed in winder is rendered inoperative until the winder is screwed in again after operating the clockwork.

It is not unusual in this connection for the wearer of the watch, following the operation of the clockwork, to forget to screw the winder in again and therefore restore the state of increased sealing. This can lead to damage to the watch if the allegedly tight watch is exposed to extreme environmental influences e.g. when bathing, diving, etc.

DESCRIPTION OF THE INVENTION

The problem of the invention is to so construct a wristwatch with a screw-in winder, that an incorrect operation of the aforementioned type is largely avoided.

This problem is solved in the case of a wristwatch of the aforementioned type in that signalling or indicating means are provided, which are operatively connected to the winder and indicate whether or not the winder is in the screwed-in state.

Therefore the essence of the invention is to construct the wristwatch in such a way that the attention of the wearer is attracted by suitable indicating means if the screw-in winder is not in the correct, screwed-in state.

It is fundamentally conceivable in the invention to use acoustic signalling means, i.e. to operate e.g. an electrically functioning buzzer by means of an electric contact connected to the winder. Such a construction would be suitable for an electrical or electronic watch, but would be less suitable for a watch having a mechanical clockwork.

Thus, according to a first, preferred embodiment of the invention the signalling or indicating means are constituted by optical display means. Although here an electrical variant in the form of a flashing light or the like is conceivable, for optical indicating means there are numerous purely mechanical implementation possibilities. One of these possibilities consists of placing under the winder a ring in an indicating colour, which is concealed when the winder is screwed in, but is clearly visible when the winder is unscrewed. However, as the winder is usually positioned laterally on the watch case, the indicating action of such an arrangement is limited.

Another preferred embodiment of the invention is characterized in that the optical display means are located within the case and that in particular the watch has a dial, the optical display means being located within the dial. As the watch dial is in an optically favourable position, a strong indicating or signalling action is obtained.

A universal usability in the case of both mechanical and electrical or electronic watches is obtained if, according to another preferred embodiment, the optical display means are constructed as mechanical means and are operated mechanically by means of the winder, the optical display means incorporating a slide, which is so displaceably mounted below the dial that it is moved between two positions on screwing in or unscrewing the winder and in which the dial has an opening located in the displacement path of the slide and through which the particular slide position can be detected.

The slide can be made very flat and is so positioned between the clockwork and the dial, that use in the most varied clockworks and watches is possible. The opening for the position indication of the slide is preferably constituted by the date display opening, provided that the watch has a separate date display.

A particularly compact construction and unreduced sealing effect is obtained if, according to another preferred embodiment, the spindle passes through a bore in the case and the spindle is concentrically surrounded within the bore by a spindle tube, which is connected to the spindle at the outer end and can be turned together with the spindle and operates the optical display means or slide on screwing in or unscrewing the spindle.

Further embodiments can be gathered from the dependent claims.

BRIEF DESCRIPTION OF THE DRAWINGS

The invention is described in greater detail hereinafter relative to embodiments and the attached drawings, wherein show.

WAYS TO IMPLEMENT THE INVENTION

Figure 1A:
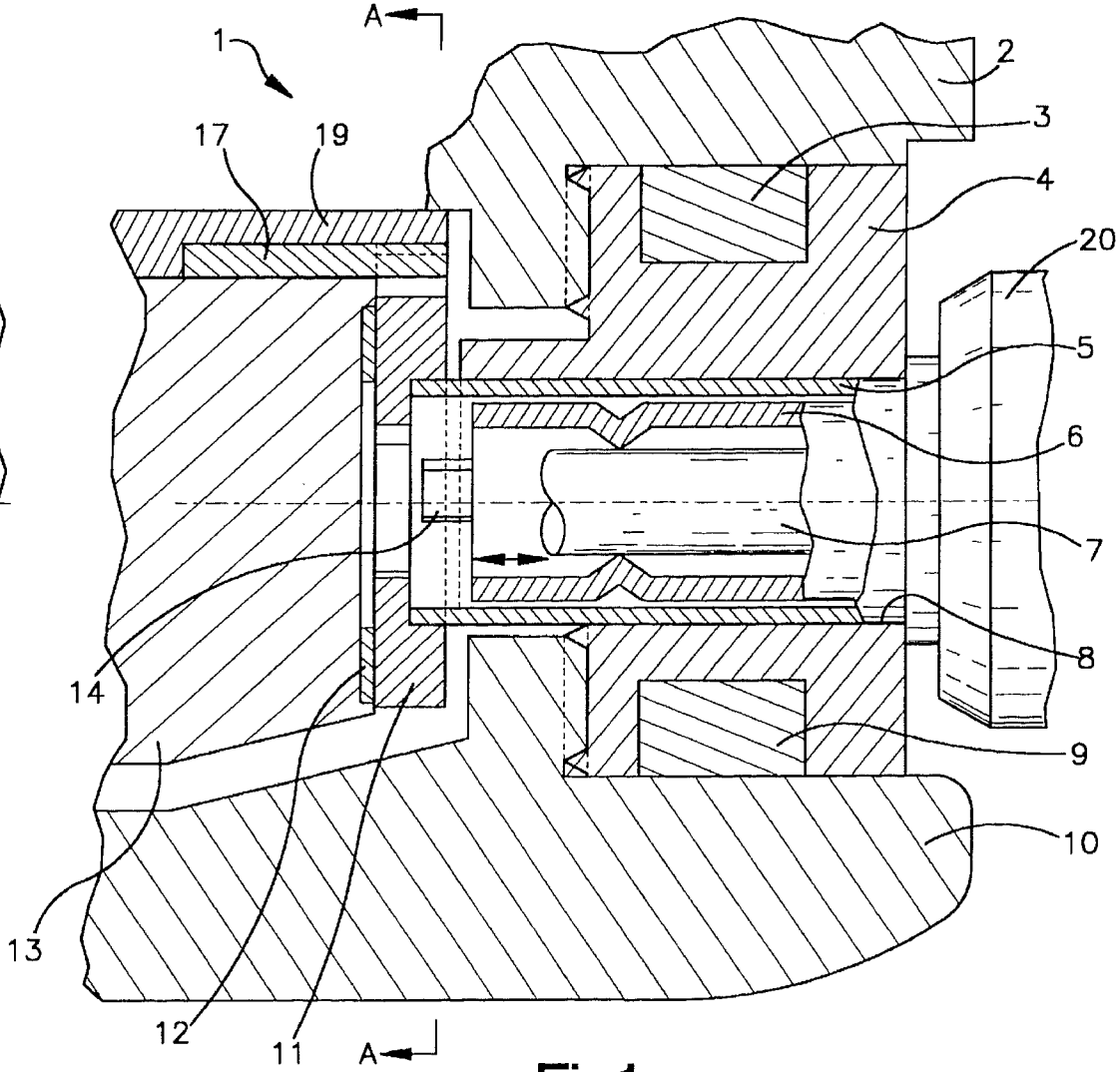
FIG. 1 A preferred embodiment for a wristwatch according to the invention in section along the spindle axis (FIG. 1*a*) and in cross-section along plane A—A of FIG. 1*a* (FIG. 1*b*).
Figure 1B:
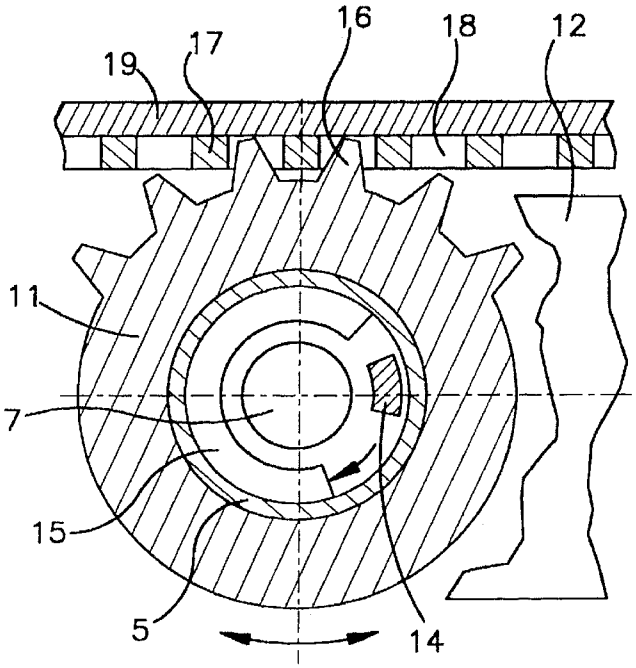

FIG. 1 shows a section through a preferred embodiment for a wristwatch according to the invention. FIG. 1*a* shows in detail the part of the watch which surrounds the winder 2, the spindle 7 connected to the winder and its passage through the watch case 2. FIG. 1*b* is a section in plane A—A of FIG. 1*a*.

The wristwatch 1 of the embodiment of FIG. 1 comprises an inner clockwork 13 with superimposed dial 19, a case 4 surrounding in annual manner the clockwork 13, a base 10 terminating the case 4 at the bottom and a border 2 terminating the case 4 at the top and which also borders the not shown glass cover. The base 10 and rim 2 are screwed into the case 4 by means of a corresponding thread, the desired sealing action being obtained by seals 3 and 9, which are placed in corresponding grooves in circular manner between the case 4 and border 2 or base 10.

The clockwork 13 can be operated (e.g. wound up or adjusted) by means of a winder 20 located on the outside of the case 4 and by means of a spindle 7 is operatively connected in not shown manner to the clockwork 13. For this purpose the spindle 7 is passed inwards through a bore 8 in the case 4. The winder 20, which is only shown in rudimentary manner in FIG. 1*a*, is constructed in per se known manner as a screw-in winder, i.e. it is sealingly screwed to the case 4 or a threaded socket fixed to the case when it is not required and it is unscrewed if the clockwork is to be operated. The screw connection can e.g. be constructed in the manner shown in the drawings of CH-A3-682 968. The threaded socket required for screwability passes into a tubus 5, which is screwed, pressed or otherwise inserted in fixed manner in the bore 8 in the case 4 and concentrically surrounds the spindle 7.

Compared with the screw connection known from CH-A3-682 968, the tubus 5 in the embodiment shown in FIG. 1 is extended inwards and projects over the inner surface of the case 4 into the interior of the watch. On the projecting end of the tubus 4 is mounted in rotary manner a toothed segment 11, which preferably has the shape shown in FIG. 1*b*. The toothed segment 11 is constructed as a circular ring. The internal diameter of the circular ring is sufficiently large for the spindle 7 to be guided without difficulty through the inner opening of the toothed segment 11 to the clockwork 13.

On the inside of the circular ring is shaped a circumferential circular ring segment 15, which has a segment angle of preferably approximately 240°. The angle of 120° not covered by the circular ring segment 15 forms an engagement area for a driving finger 14, whose function will be described hereinafter. 0n the outside of the toothed segment 11 are successively provided in the circumferential direction numerous teeth 16, which on rotating the toothed segment about the tubus axis successively engage in corresponding engagement openings 18 in a superimposed slide 17 and displace the latter in a plane parallel to the dial 19 (FIGS. 2*a*, *b*).

Figure 2B:
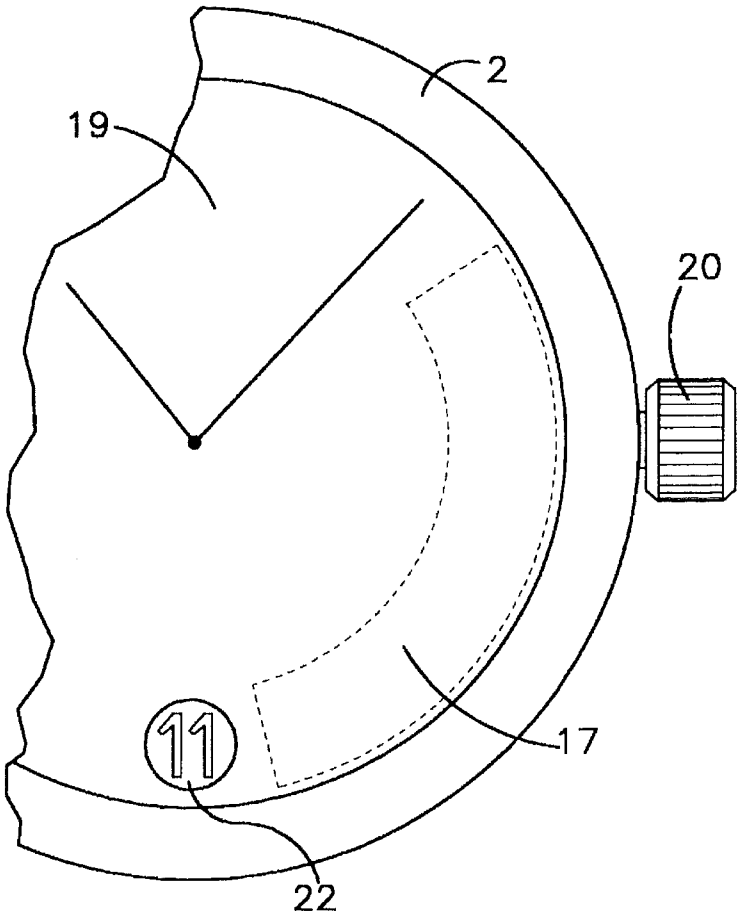
FIG. 2 The operating principle of a watch according to FIG. 1 in plan view of the dial by means of the two states with unscrewed (a) and screwed in (b) winder.
Figure 2A:
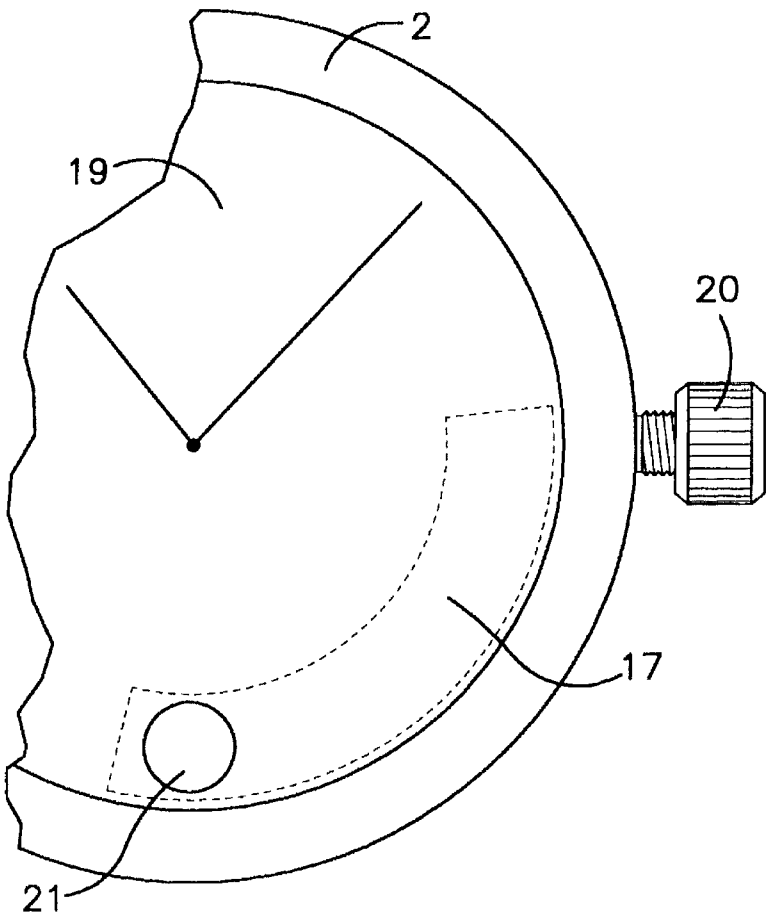

As shown in FIG. 2, the slide 17 can have the form of a circular ring segment, which on turning the toothed segment 11 is correspondingly turned by a given angle about the hand axis of the wristwatch 1. The slide 17 is placed directly below the dial 19. An opening 21 is provided in the dial 19 in the displacement path of the slide 17. The opening 21 can be specifically provided for indicating the screwing in state of the winder. However, preferably use is made of the opening of a date display 22, provided that the latter exists in the wristwatch (FIG. 2*b*).

As a function of the screwing in state of the winder 20, the slide can assume two extreme positions. In one extreme position corresponding to an unscrewed winder 20 (FIG. 2*a*), the slide 17 closes the opening 21. If the top of the slide 17 is provided in this area with a conspicuous colour contrasting with that of the dial 19 (e.g. red in the case of a white dial), the closed opening 21 appears as a red dot within the white dial. In this way the watch wearer has his attention drawn to the fact that the winder is not yet screwed in and therefore the watch is endangered. However if the winder 20 is completely screwed in, the slide 17 assumes a second extreme position (FIG. 2*b*), in which it frees the opening. The date can then be displayed in the opening in the conventional way.

The indication of the screwing in state is only particularly reliable if the transition shown in FIG. 2 between the two extreme positions of the slide 17 on screwing in the winder 20 only takes place during the final revolutions of the winder and then in a comparatively abrupt manner. In order to ensure this functional sequence, the mechanical operative connection between the winder 20 and the toothed segment 11 is given a special construction (FIG. 1). Between the tubus 5 and the spindle 7 a winder tube 6 is concentrically placed in the bore 8 of the case 4 and is firmly connected to the winder 20 and rotates with the latter. Such a winder tube also exists in the known screw-in winder of CH-A3-682 968 and provides therein the mechanical coupling of the winder to the spindle when the winder is unscrewed.

The length of the winder tube 6 is selected in such a way that, with the winder completely screwed in, on the inside it terminates at roughly the same level as the tubus 5. The aforementioned driving finger 14 is shaped on this end of the winder tube 6. In the case of a corresponding choice of the pitch of the thread on the threaded socket of the winder, it is now possible that on screwing in the winder 20 the winder tube 6 with the driving finger 14 can rotate freely in a helicoidal movement, the driving finger 14 increasingly migrating into the interior of the watch until it passes into the inner opening of the toothed segment 11 and engages with the ring segment 15. The driving finger 14 then rotates the toothed segment 11 and the slide 17 frees the opening 21 in the dial 19. An automatic rotation of the toothed segment 11 is prevented in that a spring 12 is fitted to the outside of the clockwork 13 which presses the toothed segment 11 against the tubus 5 and thus ensures the necessary friction.

It is obvious that the invention is not restricted to the embodiment described here. Particularly in the case of a mechanical indication, the coupling between the winder 20 and the indicating means 17, 21 can be differently constructed and can e.g. take place by special levers or joints. Numerous modifications are also possible with respect to the indicating means. Thus, it is inter alia possible to design the dial in such a way that when the winder is unscrewed the figures of the full hours disappear and are only visible when the winder is completely screwed in. It is also conceivable to control the display electrically by means of a contact and to use for display purposes electro-optical optical or electroacoustic means. With a comparatively high degree of reliability, the invention provides an effective means for avoiding undesired interference to a wristwatch having a screw-in winder as a result of environmental influences.

LIST OF REFERENCE NUMERALS

| | |
|---|---|
| 1 | Wristwatch |
| 2 | Rim |
| 3, 9 | Seal |
| 4 | Case |
| 5 | Tubus |
| 6 | Winder tube |
| 7 | Spindle |
| 8 | Bore |
| 10 | Base |
| 11 | Toothed segment |
| 12 | Spring |
| 13 | Clockwork |
| 14 | Driving finger |

-continued

| LIST OF REFERENCE NUMERALS |
|---|
| 15 Circular ring segment |
| 16 Tooth |
| 17 Slide |
| 18 Engagement opening |
| 19 Dial |
| 20 Winder |
| 21 Opening |
| 22 Date display |

We claim:

1. Wristwatch (1) with a clockwork (3), which is surrounded by a case (4) and which is operable by means of a winder (20) fitted in rotary manner to the outside of the case (4) by a spindle (7) guided through said case (4), the winder (20) being constructed so that it can be screwed in in sealed manner, characterized in that indicating means are provided, which are in operative connection with the winder (20) and indicate whether or not the said winder (20) is in the screwed in state.

2. Wristwatch according to claim 1, characterized in that the indicating means are constituted by optical display means.

3. Wristwatch according to claim 2, characterized in that the optical display means are located within the case (4).

4. Wristwatch according to claim 3, characterized in that the watch has a dial (19) and that the optical display means are located within the dial (19).

5. Wristwatch according to claim 4, characterized in that the optical display means are constructed as mechanical means and are operated mechanically through the winder (20).

6. Wristwatch according to claim 5, characterized in that the optical display means comprise a slide (17), which is displaceably mounted below the dial (19) in such a way that on screwing in or unscrewing the winder (20) it can be displaced between two positions and that in the dial there is an opening (21) located in the displacement path of the slide (17) and through which it is possible to detect the position of the slide (17).

7. Wristwatch according to claim 6, characterized in that the watch has a separate date display (22) and that the opening for the date display (22) is used as the opening (21) for the position indication of the slide (17).

8. Wristwatch according to claim 5, characterized in that the spindle (7) is guided through a bore (8) in the case (4) and that the spindle (7) within said bore (8) is concentrically surrounded by a winder tube (6), which is connected at the outer end to the winder (20) and can be turned together with the winder (20) and operates the optical display means slide (17) on screwing in or unscrewing the winder (20).

9. Wristwatch according to claim 8, characterized in that the winder tube (6) has at the inner end a driving finger (14), which on screwing in the winder (20) engages in a toothed segment (11) mounted in rotary manner about the axis of the spindle (7), said toothed segment (11) engaging with its teeth (16) in corresponding engagement openings (18) in the slide (17) and displaces the slide (17) during rotation.

10. Wristwatch according to claim 8, characterized in that the operative connection between the winder tube (6) and the optical display means or slide (7) is so constructed that on screwing in or unscrewing the winder (20) it only exists at the start and finish of the screwing process.

* * * * *